United States Patent [19]

Jacobsson

[11] 4,039,155

[45] Aug. 2, 1977

[54] THREAD STORING AND FEEDING DEVICE

[75] Inventor: Kurt Arne Gunnar Jacobsson, Ulricehamn, Sweden

[73] Assignee: AB IRO, Ulricehamn, Sweden

[21] Appl. No.: 663,755

[22] Filed: Mar. 4, 1976

[30] Foreign Application Priority Data

Mar. 7, 1975 Germany ..... 2510048

[51] Int. Cl.[2] ..... B65H 51/20

[52] U.S. Cl. ..... 242/47.12; 242/47.01

[58] Field of Search ..... 242/47.12, 47.13, 47.01, 242/47.02, 47.03, 47.04, 47.05, 47.06, 47.07, 47.08, 47.09, 47.1, 47.11; 66/132 R

[56] References Cited

U.S. PATENT DOCUMENTS

| | | | |
|---|---|---|---|
| 3,419,225 | 12/1968 | Rosen | 242/47.12 |
| 3,642,219 | 2/1972 | Rosen | 242/47.12 |
| 3,904,141 | 9/1975 | Rosen | 242/47.12 |

*Primary Examiner*—Stanley N. Gilreath

*Attorney, Agent, or Firm*—Blanchard, Flynn, Thiel, Boutell & Tanis

[57] ABSTRACT

A thread storing and feeding device for a textile machine, which device includes a storage drum to which the thread can be tangentially fed to form a thread supply and from which it can be withdrawn particularly overend. A disc is movably supported with respect to the drum for displacing the thread supply axially along the drum. The drum has a closed circumferential wall provided with a plurality of longitudinally extending, circumferentially spaced grooves formed in the exterior surface thereof. The movable disc is positioned adjacent the upper end of the drum and has an edge section which overlaps the upper edge of the drum. This edge section has a plurality of webs thereon which project inwardly into the longitudinal grooves of the drum. The webs define a lower thread engaging surface which engages the threads so as to push the thread storage axially along the drum.

6 Claims, 3 Drawing Figures

THREAD STORING AND FEEDING DEVICE

The invention relates to a thread storing and feeding device for textile machines, comprising a storage drum to which the thread can be tangentially fed to form a thread supply and from which it can be withdrawn particularly overend, and comprising a sliding disc for displacing the thread supply on the storage drum.

BACKGROUND OF THE INVENTION

Such a device is already known (German Pat. No. 1,635,899). It comprises a rotatable storage drum with longitudinal slits open at one end of said drum. The sliding disc can be tilted on the drum axle about a pin extending transversely through the latter and is mounted for rotation with the drum by means of ball bearings in such a manner that it is located substantially within the drum wall. On its circumference the disc comprises arms extending outwardly through the longitudinal slits in the drum wall. The inclined position of the sliding disc is determined firstly by a spring engaging thereon, and secondly by the thread supply on the drum wall which acts on the arms, and is used to actuate a switch which switches the drum drive on or off depending on the size of the thread supply.

There is also a known thread storing and feeding device for positive thread feeding (German Offenlegungsschrift No. 2,159,155) in which the storage drum is designed as a cage of rods inside which the sliding disc is arranged with arms extending through the intermediate spaces in the cage. In addition, there are known thread storing and feeding devices comprising a stationary drum and a thread guide which can be rotated about the storage drum to take up the thread, each of which devices likewise comprises a storage drum with longitudinal slits in the walls and a plate obliquely mounted inside the wall with arms extending outwardly through the slits. A feature common to all the previously described known devices is that the drum wall is broken up by numerous longitudinal slits or, in the case of the cage design, intermediate spaces or gaps. It does not therefore have any high strength properties, particularly if the longitudinal slits are open at one end of the drum.

The problem for the invention is to provide a thread storing and feeding device of the type described at the beginning, which comprises a storage drum of sturdy design and with which reliable take-up of the thread windings on the drum is still ensured simply by the sliding disc.

The problem is solved in accordance with the invention in that the storage drum comprises a wall closed on the circumference with longitudinal grooves on the outside, and the sliding disc has an edge overlapping the upper edge of the storage drum and webs, teeth or fingers extending inwardly into the longitudinal grooves in the drum.

The closed drum wall is solid and non-deformable. These properties are further improved by the webs having the full thickness of the wall being left between the grooves. Manufacture is no more costly than manufacture of a slotted drum wall and more economical than making a rodlike cage closed at the top, and assembly is simpler. A further advantage of the closed drum wall is that unavoidable worn particles of thread and the like cannot settle in the grooves as between slits, nor can they reach the interior of the drum. Depending on whether the drum and sliding disc are rotatable or stationary, the disc according to the invention can be mounted on the drum axle in the same manner as is known for sliding discs which have arms extending through the drum wall. The only requirement is that either the bearing be set slightly higher in relation to the drum and/or the sliding disc be bent at an angle to fit overthe edge of the drum. The sliding disc can be mounted so as to be vertically movable in known manner or tiltable depending on the thread supply and spring load, the movements of the said disc being used to control take-up of the thread.

The longitudinal grooves can have a maximum depth of approximately two-thirds of the thickness of the drum wall. The webs, teeth or fingers of the sliding disc are thus provided with sufficient play or space necessary for sliding discs which vary their angle of inclination relative to the drum axle. Firstly, engagement of the webs, etc. in the upward pivoted section should be maintained as far as possible, and secondly the webs, etc. in the downward pivoted section should not be firmly fixed on the drum wall.

Embodiments of thread storing and feeding devices according to the invention are illustrated in the drawings.

DETAILED DESCRIPTION

Figure 1:
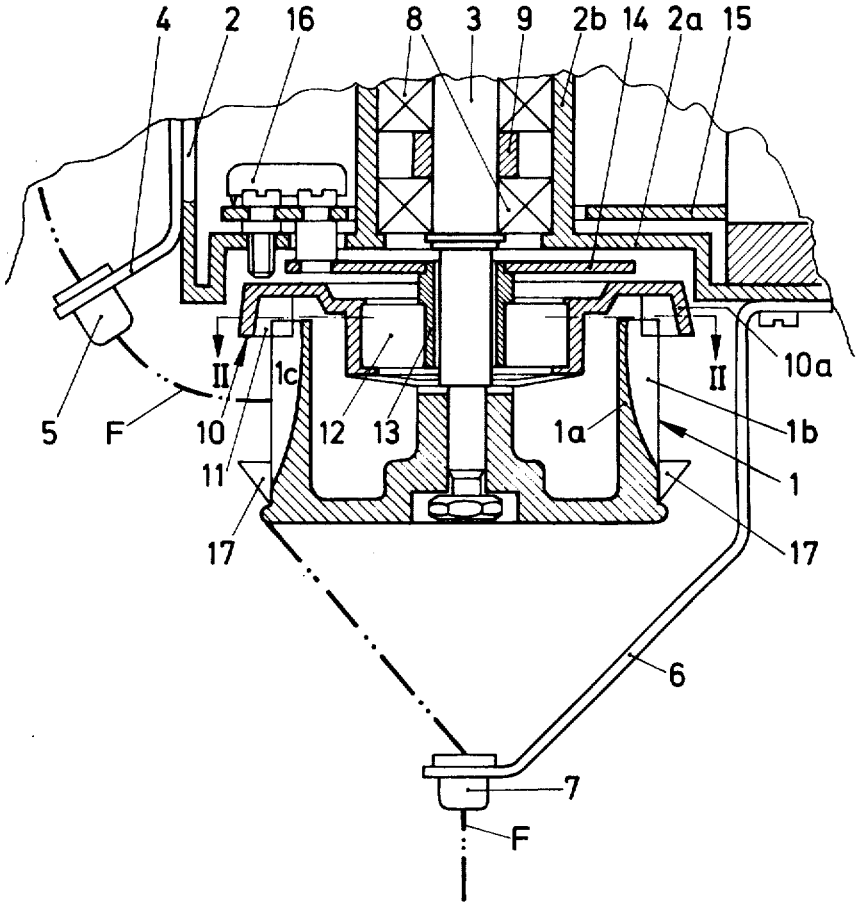
FIG. 1 shows part of a device in longitudinal section.
Figure 2:
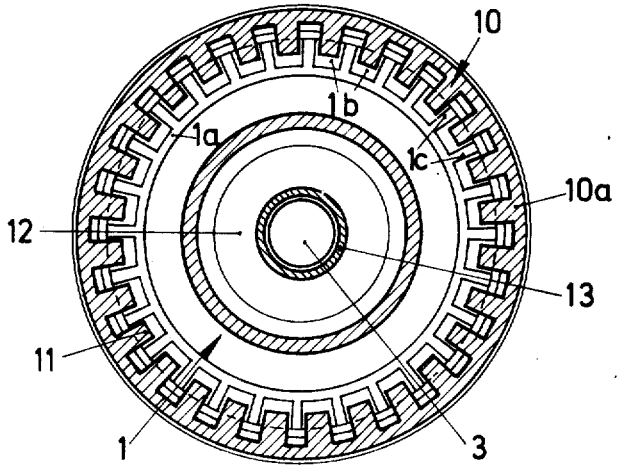
FIG. 2 shows a cross-section along the line II-II in FIG. 1.

The thread storing and feeding device shown in FIGS. 1 and 2 is intended for a sewing machine. The illustrated section comprises substantially a storage drum generally designated by reference numeral 1 and its bearing or mounting area. The storage drum is mounted in a housing 2 by means of a drum axle 3 which is rotatably driven in an unshown manner. Attached to the housing is an angle element 4 with a thread guide 5 for the thread F to be delivered, and a support arm 6 with a thread guide 7 for the thread to be withdrawn from the drum. A bearing sleeve **2*b*, integral with the bottom 2*a* of the housing, extends inside the housing from the bottom 2*a* near the storage drum 1. Roller bearings 8, separated by a spacer 9, are mounted in the said sleeve 2*b* to support the drum axle 3**.

The storage drum 1 comprises a cylindrical wall **1*a* closed on the circumference, with longitudinal grooves 1*b* arranged around its outer side. With a constant depth of approximately two-thirds the thickness of the drum wall, the grooves extend almost halfway down the drum from the end of the drum facing the housing, ending in the form of an arc or curve in the vicinity of the lower drum edge. The solid marginal sections remaining between the grooves 1*b* form ribs 1*c*. The storage drum 1 is associated with a sliding disc 10 having an edge section 10*a* which is approximately U-shaped in cross-section and extends around the edge of the drum near the housing. Webs 11 extend inwardly into the grooves 1*b* from the edge 10*a*, which webs have flat bottom surfaces disposed transversely with respect to the circumference of the drum. The sliding disc 10 is rotatably mounted by means of bearings 12 on a boss 13 which surrounds the drum axle 3 with radial play, and is vertically displaceable, and the ideal center line of which is inclined relative to the center line of the drum axle, extending outside the plane of the drawing. The angle of inclination is therefore not evident from FIG. 1. It is approximately equal to the inclination of the boss in FIG. 3. Accordingly, the sliding disc is also inclined relative to the drum. The boss 13 is rigidly connected to a circular bearing plate 14 which extends above the sliding disc 10 and below the housing bottom 2***a*. The bearing plate 14 is supported on a pivot lever 15, only partially shown in FIG. 1, which extends flatly in one plane above the bottom 2*a* of the housing and is mounted outside the area shown in the drawing. The lever 15 is associated with a microswitch 16 which can be actuated depending on the position of the lever and therefore on the position of the sliding disc 10.

The described device operates in the following manner: The thread F is wound on to the storage drum 1 through rotation thereof and forms a thread supply. The thread windings are axially displaced downwardly on the drum by engagement with the flat bottom surfaces on the webs 11 of the disc 10, the thread F is withdrawn overend from the drum under a braking ring 17 and passes via the thread guide 7 to a working place, in this case a sewing machine. Depending on the thread supply on the storage drum 1 the sliding disc 10, which participates in the rotation of the drum, is moved upwardly or downwardly on the drum axle 3 together with its bearings 12. This motion is transmitted to the lever 15 via the boss 13 and bearing plate 14. The microswitch 16 is actuated upon reaching a predetermined upper or lower position which corresponds to a desired or necessary maximum or minimum thread supply.

Figure 3:
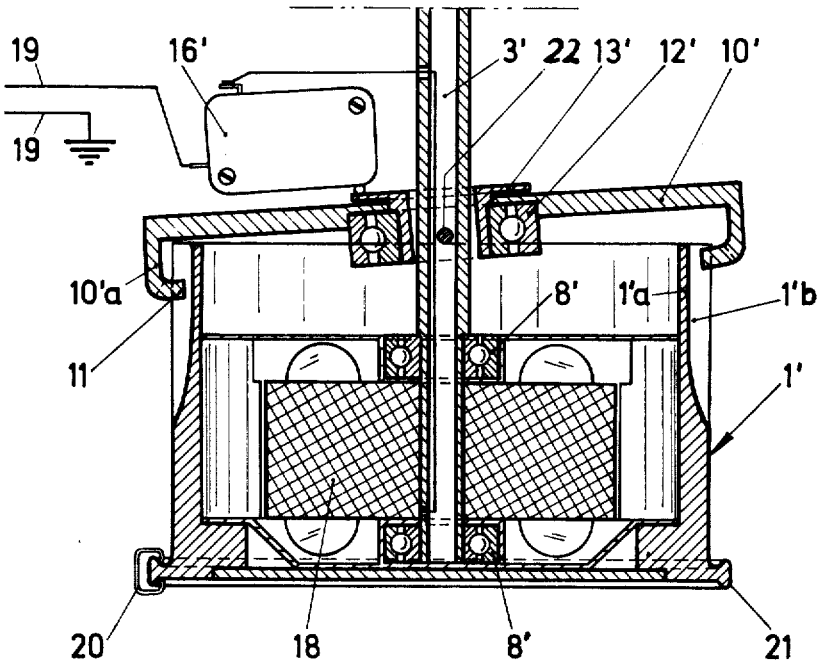
FIG. 3 shows a further embodiment of the device in longitudinal section.

FIG. 3 shows a further embodiment of a device comprising a storage drum 1'. The wall 1'*a* of the said drum comprises outer longitudinal grooves 1'*b*, as with the storage drum 1 shown in FIGS. 1 and 2. The drum 1' is designed as a rotor of an electric motor 18 mounted inside said drum and connected to a microswitch 16' by leads 19. The microswitch is in contact with a sliding disc 10' rotatably mounted on a boss 13' by means of ball bearings 12', the boss 13' in turn being mounted on the drum axle 3' so as to be pivotable about a pin 22 perpendicular to the boss. A U-shaped edge 10'*a* of the sliding disc 10'extends around and grips the upper edge of the drum 1' and fingers 11', bent at an angle on the edge, extend inwardly into the longitudinal grooves 1'*b*.

The manner of operating the device shown in FIG. 3 corresponds substantially to the mode of operation described with reference to the device in FIGS. 1 and 2. The fingers 11' on the sliding disc cause the taken up thread windings to be displaced in the direction of the lower end of the drum. The size of the thread supply in turn controls the inclination of the disc 10' and therefore the microswitch 16'. In the case of the device shown in FIG. 3 thread is withdrawn through a traveller 20 running around a flange 21 provided at the lower end of the drum.

The invention is not limited to the illustrated embodiment. Also with known devices comprising a stationary storage drum and a thread take-up element rotating about the drum, the said drum can be designed with a closed wall and outer longitudinal grooves and the sliding disc designed to grip around the edge of the drum with fingers, teeth or webs extending inwardlyinto the grooves. The thread drum and sliding disc according to the invention can also be designed for thread feeding and storing devices for so-called positive thread feeding, from which the thread is tangentially withdrawn again and a sliding disc serves mainly to control the thread supply.

Instead of having a surrounding U-shaped edge, the sliding disc can be designed without an edge and only with U-shaped hooks or fingers, or attached webs.

What I claim is :

1. In a thread storing and feeding device for textile machines, comprising a storage drum to which the thread can be tangentially fed to form a thread supply and from which it can be withdrawn particularly overend, and a disc movable with respect to the drum for displacing the thread supply axially along the drum, the disc having a thread engaging surface which extends transversely with respect to the exterior drum surface and which engages the thread storage for pushing it axially along the drum, the improvement wherein the storage drum has a closed circumferential wall provide with a plurality of longitudinally extending, circumferentially spaced grooves formed in the exterior surface thereof, and the movable disc having an edge section overlapping the upper edge of the drum and being provided with a plurality of webs or teeth which extend inwardly into the longitudinal grooves, the lower surfaces of said teeth defining said thread engaging surface.

2. A device as claimed in claim 1, wherein the longitudinal grooves extend down from the upper edge of the drum with an approximately constant depth and end in the form of an arc or curve in the vicinity of the lower edge of the drum.

3. A device as claimed in claim 2, wherein the longitudinal grooves have a maximum depth equal to approximately two-thirds the thickness of the drum wall.

4. A device as claimed in claim 1, wherein the longitudinal grooves have a maximum depth equal to approximately two-thirds the thickness of the circumferential drum wall.

5. A device as claimed in claim 1, wherein the edge section of said disc includes a platelike base portion which projects radially outwardly in overlapping relationship to the upper end of the circumferential wall of the drum, said edge section also including an annular flange portion fixed to the radially outer edge of said base portion and projecting axially downwardly therefrom so that said flange portion concentrically surrounds but is radially spaced outwardly from the circumferential wall of the drum, said flange portion axially overlapping at least a portion of the circumferential wall adjacent the upper end of the drum, and said webs being fixed to said flange portion and projecting radially inwardly toward the circumferential wall of the drum so as to project into the grooves.

6. A device as claimed in claim 5, wherein the thread engaging surface as defined on the bottom of said webs extends in a plane which is substantially perpendicular to the longitudinal axis of said movable disc.

* * * * *